US010604878B2

(12) United States Patent
Leibman et al.

(10) Patent No.: US 10,604,878 B2
(45) Date of Patent: Mar. 31, 2020

(54) WASHING MACHINE APPLIANCE WITH A ROTATING DOCKING STATION

(71) Applicant: Haier US Appliance Solutions, Inc., Wilmington, DE (US)

(72) Inventors: Alexander B. Leibman, Prospect, KY (US); Lucius Levon Cole, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 15/898,769

(22) Filed: Feb. 19, 2018

(65) Prior Publication Data

US 2019/0257017 A1 Aug. 22, 2019

(51) Int. Cl.

| | |
|---|---|
| ***D06F 29/00*** | (2006.01) |
| ***D06F 39/08*** | (2006.01) |
| ***D06F 23/04*** | (2006.01) |

(52) U.S. Cl.

CPC ..... *D06F 29/00* (2013.01); *D06F 23/04* (2013.01); *D06F 39/088* (2013.01); *D06F 2232/06* (2013.01)

(58) Field of Classification Search

CPC ..... D06F 29/00

See application file for complete search history.

(56) References Cited

U.S. PATENT DOCUMENTS

| | | | | |
|---|---|---|---|---|
| 6,948,527 | B2 * | 9/2005 | Ragner | A47L 9/24 138/118 |
| 7,384,005 | B1 * | 6/2008 | Caine | B08B 9/093 239/229 |
| 2007/0151311 | A1 | 7/2007 | McAllister et al. | |
| 2016/0102425 | A1 | 4/2016 | Scheckelhoff | |
| 2016/0138207 | A1 | 5/2016 | Del Pos et al. | |

FOREIGN PATENT DOCUMENTS

| | | |
|---|---|---|
| CN | 106868776 A | 6/2017 |

* cited by examiner

*Primary Examiner* — Jason Y Ko

(74) *Attorney, Agent, or Firm* — Dority & Manning, P.A.

(57) ABSTRACT

A washing machine appliance includes a cabinet with a panel. An auxiliary spray assembly includes a spray body. A hose is coupled to the spray body. A docking station is mounted to the panel of the cabinet at a hole of the panel. The docking station is rotatable relative to the panel within the hole of the panel.

16 Claims, 5 Drawing Sheets

WASHING MACHINE APPLIANCE WITH A ROTATING DOCKING STATION

FIELD OF THE INVENTION

The present subject matter relates generally to washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. More specifically, a predetermined volume of wash fluid is typically provided through a primary dispenser positioned at a back wall of the washing machine appliance. However, in certain situations, a user may wish to have additional wash fluid dispensed into the tub and/or may wish to direct the flow of wash fluid onto a particular garment or within a specific region of the wash tub, e.g., to perform a pretreating operation or to saturate a particular article of clothing. The ability to adjust the amount and dispensing location of wash fluid is a commercially desirable feature and increases the user's positive perception of the wash process generally. However, conventional auxiliary spray devices require complex plumbing configurations.

BRIEF DESCRIPTION OF THE INVENTION

The present subject matter provides a washing machine appliance that includes a cabinet with a panel. An auxiliary spray assembly includes a spray body. A hose is coupled to the spray body. A docking station is mounted to the panel of the cabinet at a hole of the panel. The docking station is rotatable relative to the panel within the hole of the panel. Additional aspects and advantages of the invention will be set forth in part in the following description, or may be apparent from the description, or may be learned through practice of the invention.

In a first example embodiment, a vertical axis washing machine appliance includes a cabinet with a top panel positioned at a top portion of the cabinet. The top panel defines a hole that extends through the top panel. A wash tub is positioned within the cabinet below the top panel. A wash basket is mounted within the wash tub such that the wash basket is rotatable relative to the wash tub about a vertical axis. An auxiliary spray assembly includes a spray body that defines a plurality of ports. A hose is coupled to the spray body such that fluid is flowable into the spray body through the hose. A docking station is mounted to the top panel of the cabinet at the hole of the top panel. The spray body is adjustable between a docked configuration and an undocked configuration relative to the docking station. The spray body is positioned on the docking station in the docked configuration. The spray body is spaced from the docking station in the undocked configuration. The docking station is rotatable relative to the top panel within the hole of the top panel.

In a second example embodiment, a washing machine appliance includes a cabinet with a panel. The panel defines a hole that extends through the panel. A wash tub is positioned within the cabinet. A wash basket is mounted within the wash tub such that the wash basket is rotatable relative to the wash tub. An auxiliary spray assembly includes a spray body that defines a plurality of ports. A hose is coupled to the spray body such that fluid is flowable into the spray body through the hose. A docking station is mounted to the panel of the cabinet at the hole of the panel. The spray body is adjustable between a docked configuration and an undocked configuration relative to the docking station. The spray body is positioned on the docking station in the docked configuration. The spray body is spaced from the docking station in the undocked configuration. The docking station is rotatable relative to the panel within the hole of the panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
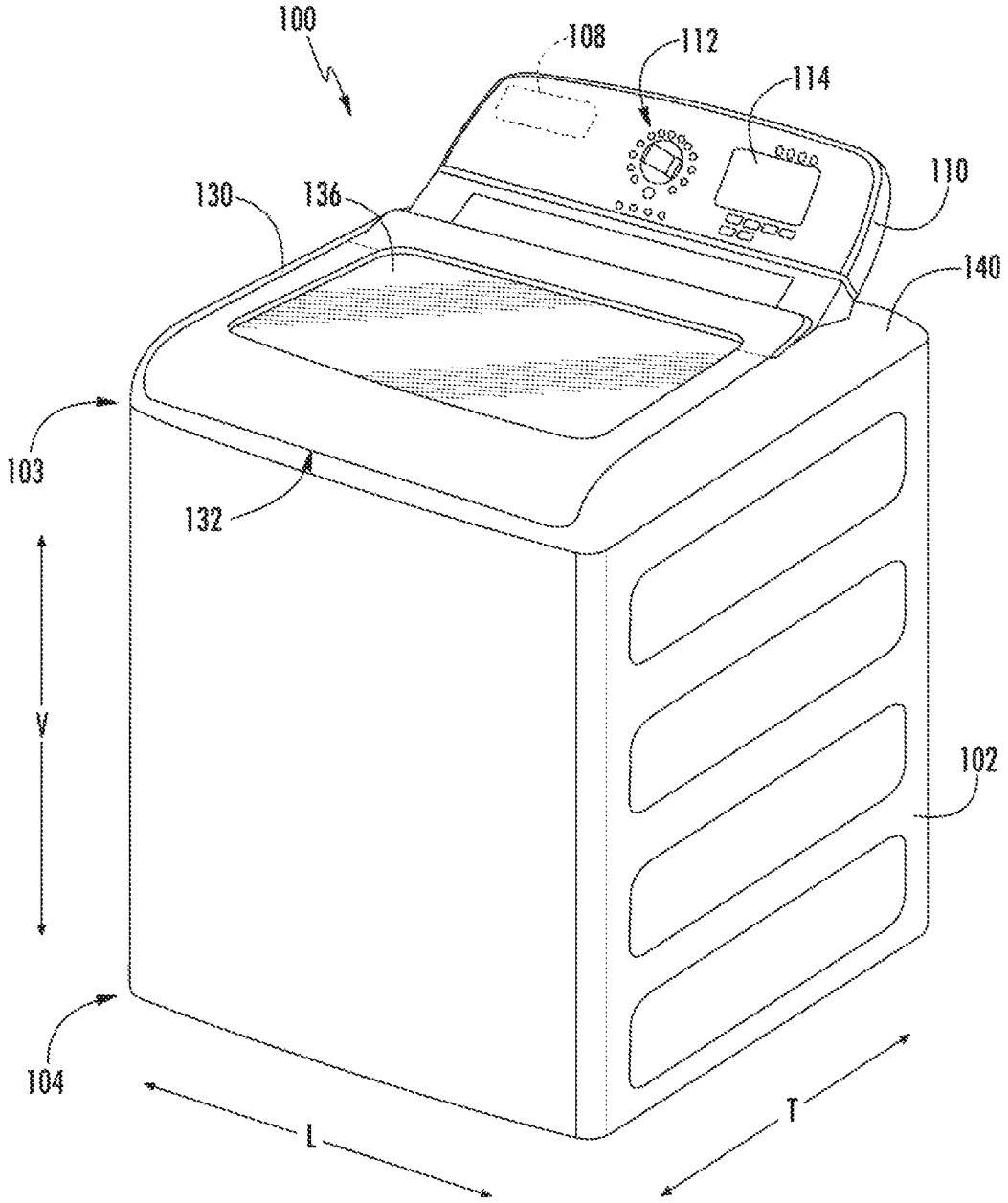
FIG. 1 is a perspective view of a washing machine appliance according to an example embodiment of the present subject matter with a door of the example washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
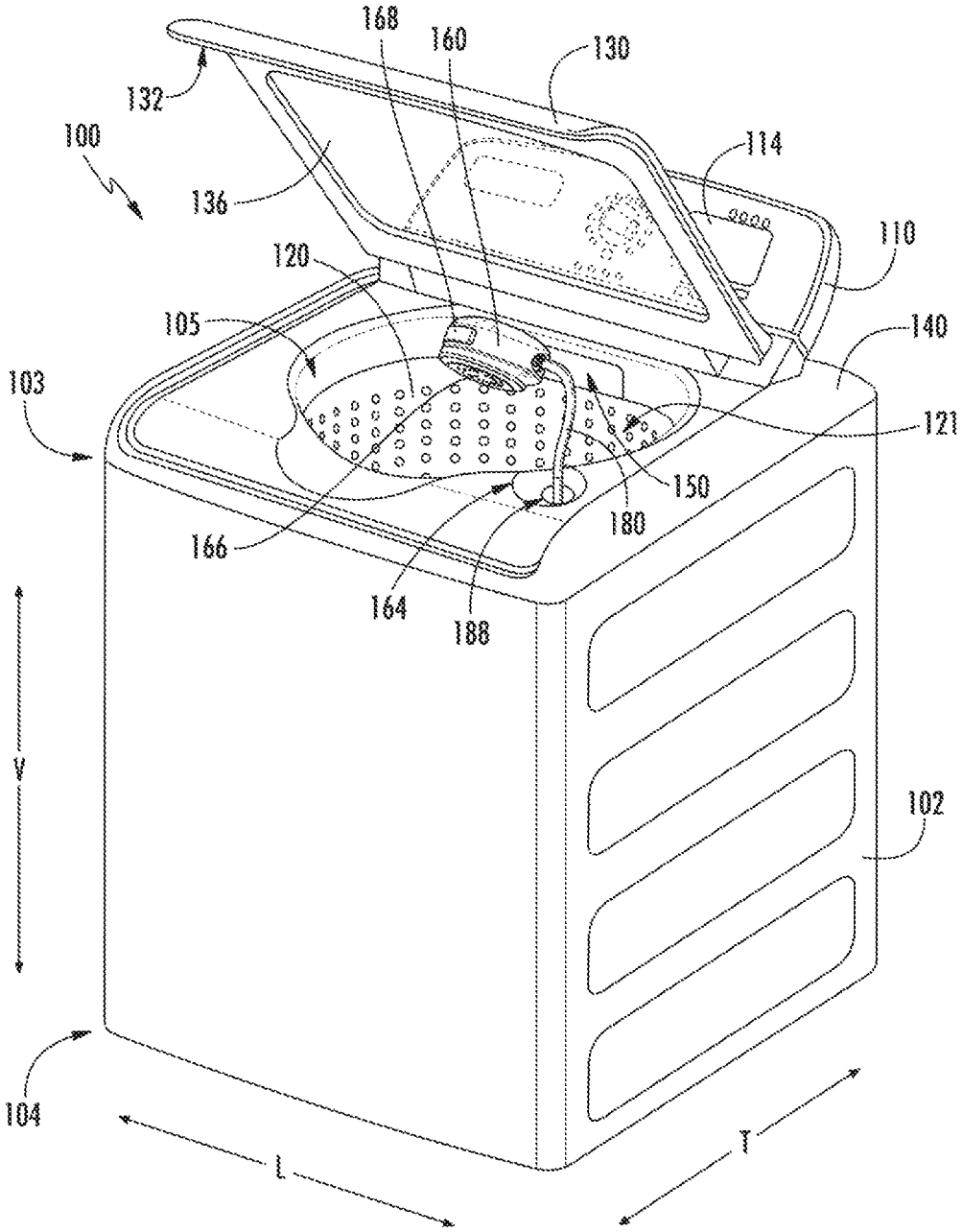
FIG. 2 is a perspective view of the example washing machine appliance of FIG. 1 with the door shown in an open position.

FIGS. 1 and 2 illustrate an example embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T. The vertical direction V, lateral direction L, and transverse direction T are mutually perpendicular and form an orthogonal coordinate system.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via a primary dispenser (see FIG. 2). One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

As shown in FIG. 2, an auxiliary spray body 160 and a hose 180 for providing a flow of wash fluid to auxiliary spray device will 160 be described in more detail according to an example embodiment. Auxiliary spray body 160 is generally configured for providing a flow of wash fluid into wash tub 121. More specifically, according to the illustrated example embodiment, auxiliary spray body 160 is positioned within top panel 140 or another easily accessible location for a user when door 130 is in the open position. In particular, top panel 140 may define a docking port or station 164 for receiving auxiliary spray body 160 when not in use. In this manner, door 130 may be closed when auxiliary spray body 160 is not in use and is positioned within docking station 164 such that auxiliary spray body 160 is stored beneath door 130. Docking station 164 may be positioned at a front, right corner of top panel 140 in certain example embodiments.

Auxiliary spray body 160 is generally configured for directing the flow of wash fluid in the desired direction, generating the desired spray pattern, or otherwise stopping and starting the flow of wash fluid. For example, auxiliary spray body 160 may define a plurality of spray ports 166 configured for discharging a flow of wash fluid in the desired pattern. Auxiliary spray body 160 may further include a button 168 that is operably coupled with auxiliary spray body 160 such that auxiliary spray body 160 is configured for discharging wash fluid when button 168 is pressed.

Button 168 may be any button or switch suitable for regulating fluid flow. For example, button 168 may include a normally closed valve that is opened when depressed. Button 168 may alternatively be a push button switch, a toggle switch, a rocker switch, or any other suitable tactile switch, such as a capacitive touch buttons configured for regulating a flow of wash fluid. Moreover, according to an example embodiment, auxiliary spray body 160 may be configured to provide a flow of wash fluid when removed from the docking station 164.

In FIG. 2, button 168 is located on auxiliary spray body 160. However, in alternative example embodiments, button 168 may be mounted on control panel 110 of washing machine appliance 100, e.g., button 168 may be one of input selectors 112. During operation, a user may wish to add additional water to wash tub 121, e.g., to prewash one or more articles of clothing or due to a perceived need for more water to effectively wash a load. The user may actuate auxiliary spray body 160 using button 168 to supply such wash fluid or water.

As illustrated, hose 180 may be a semi-rigid or flexible hose that supplies water to auxiliary spray body 160. As an example, hose 180 may be constructed from any suitably flexible conduit, such as vinyl or rubber. Hose 180 is generally any fluid conduit that extends from a fluid supply to a location suitable for discharging wash fluid into wash tub 121. In this regard, for example, hose 180 may include an inlet that is coupled to a water supply and an outlet that is coupled to auxiliary spray body 160. In particular, hose 180 may extend underneath top panel 140 between the fluid supply and auxiliary spray body 160. Thus, hose 180 may be coupled to auxiliary spray body 160 such that fluid is flowable from the water supply into auxiliary spray body 160 through hose 180. The fluid may then exit auxiliary spray body 160 at spray ports 166.

Figure 3:
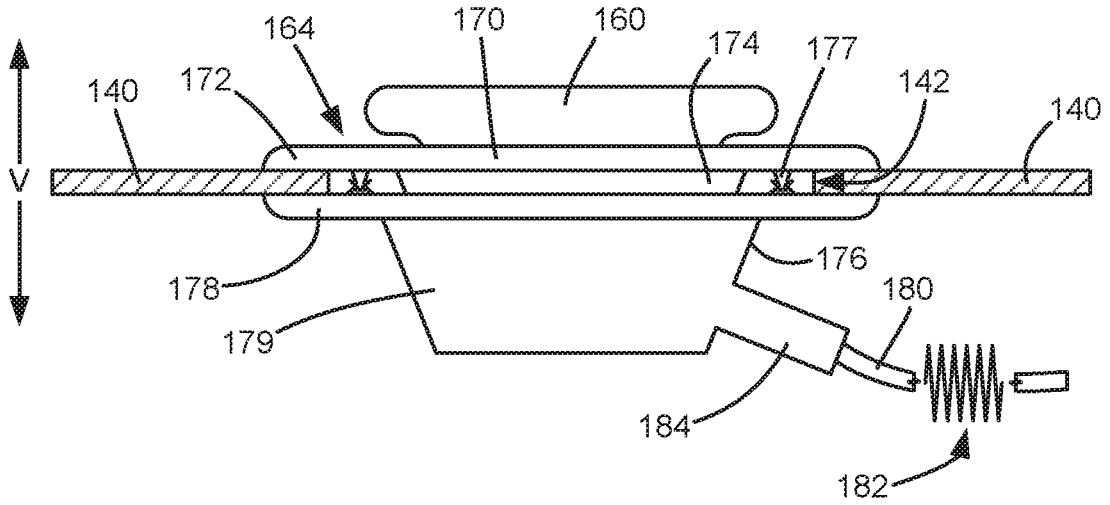
FIGS. 3 and 4 are side elevation views of certain components of the example washing machine appliance of FIG. 1 with an auxiliary spray body shown in various configurations.
Figure 4:
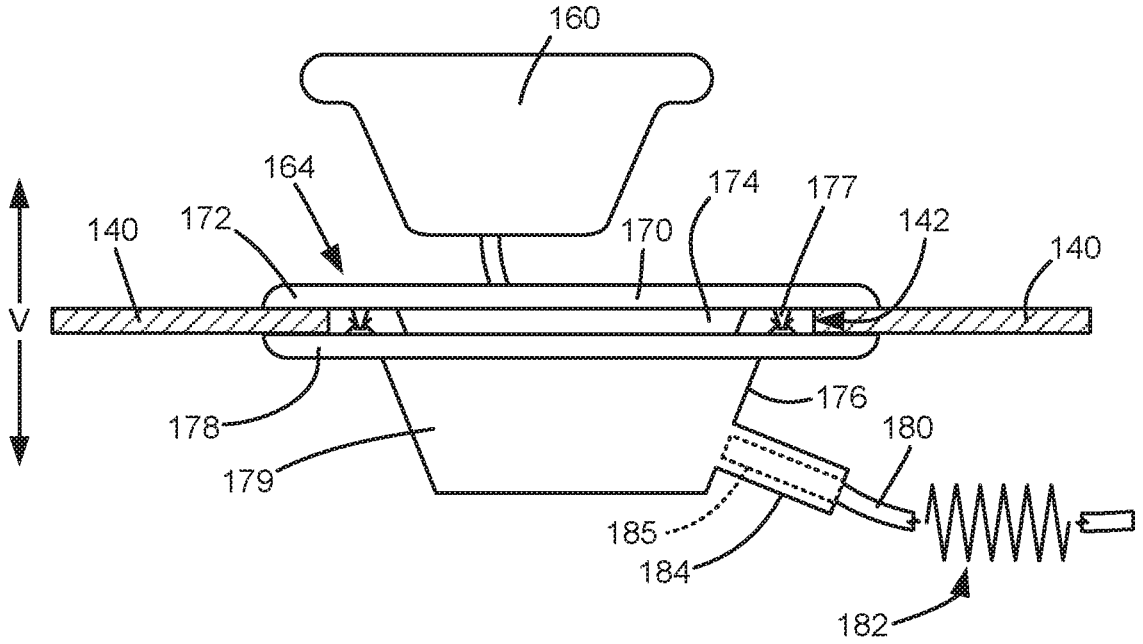

FIGS. 3 and 4 are side elevation views of auxiliary spray body 160 and docking station 164. As noted above, auxiliary spray body 160 may be stored within docking station 164. In addition, auxiliary spray body 160 may be removed from docking station 164 and used, e.g., to apply fluid at a suitable location. Thus, auxiliary spray body 160 may be adjustable between a docked configuration (FIG. 3) and an undocked configuration (FIG. 4) relative to docking station 164. Auxiliary spray body 160 may be positioned on or in docking station 164 in the docked configuration. Conversely, auxiliary spray body 160 may be spaced from docking station 164 in the undocked configuration.

When auxiliary spray body 160 is in the undocked configuration, a user may position auxiliary spray body 160 over wash tub 121 and selectively provide wash fluid into wash tub 121 or onto an article of clothing via auxiliary spray body 160. Hose 180 extends and retracts through docking station 164 when auxiliary spray body 160 adjusts between the docked configuration and the undocked configuration. In particular, most or all of hose 180 may be retracted under top panel 140 and/or within docking station 164 when auxiliary spray body 160 is in the docked configuration. Conversely, at least a portion of hose 180 may be extracted from docking station 164 when auxiliary spray body 160 shifts from the docked configuration to the undocked configuration.

Hose assembly 180 may further include a retraction mechanism 182 for urging hose 180 into tension, e.g., such that auxiliary spray body 160 is urged towards and/or into docking station 164 when not in use. Retraction mechanism 182 may correspond to a plurality of resilient coils formed by hose 180. Thus, at least a portion of hose 180 may be bent into the coils such that the coils generally urge hose 180 to retract through docking station 164 and/or urge auxiliary spray body 160 back toward docking station 164. Specifically, in operation, a user may pull on auxiliary spray body 160 such that retraction mechanism 182 (e.g., coiled hose) extends and/or elastically deforms to permit a user to dispense wash fluid where desired. After the user is finished using auxiliary spray body 160 for providing wash fluid into wash tub 121, the user may release auxiliary spray body 160 and the resiliency in flexible hose 180 due to retraction mechanism 182 may draw flexible hose 180 back into hose housing 186 and into the retracted position. However, according to alternative example embodiments, retraction mechanism 182 may be a torsional spring, a linear spring, a weighted loop, a coiling/winding mechanism, or any other suitable mechanism for retracting hose 180.

As shown in FIGS. 3 and 4, top panel 140 defines a hole 142 that extends through top panel 130, e.g., along the vertical direction V. Docking station 164 is mounted to top panel 140 at hole 142. In alternative example embodiments, docking station 164 may be mounted to any other suitable panel of washing machine appliance 100, such as a front panel or one of the side panels of cabinet 102. Thus, while described in greater detail below in the context of top panel 140 of washing machine appliance 100, it will be understood that the present subject matter is not limited to mounting of docking stations on top panels of vertical axis washing machine appliances.

As noted above, hose 180 extends and retracts through docking station 164 when auxiliary spray body 160 adjusts between the docked configuration (FIG. 3) and the undocked configuration (FIG. 4). Docking station 164 includes features for limiting or preventing a kink in hose 180 when hose 180 is extended through docking station 164, e.g., at the interface between hose 180 and docking station 164. In particular, docking station 164 is mounted to top panel 140 such that docking station 164 is rotatable relative to top panel 140 within hole 142 of top panel 140.

Figure 5:
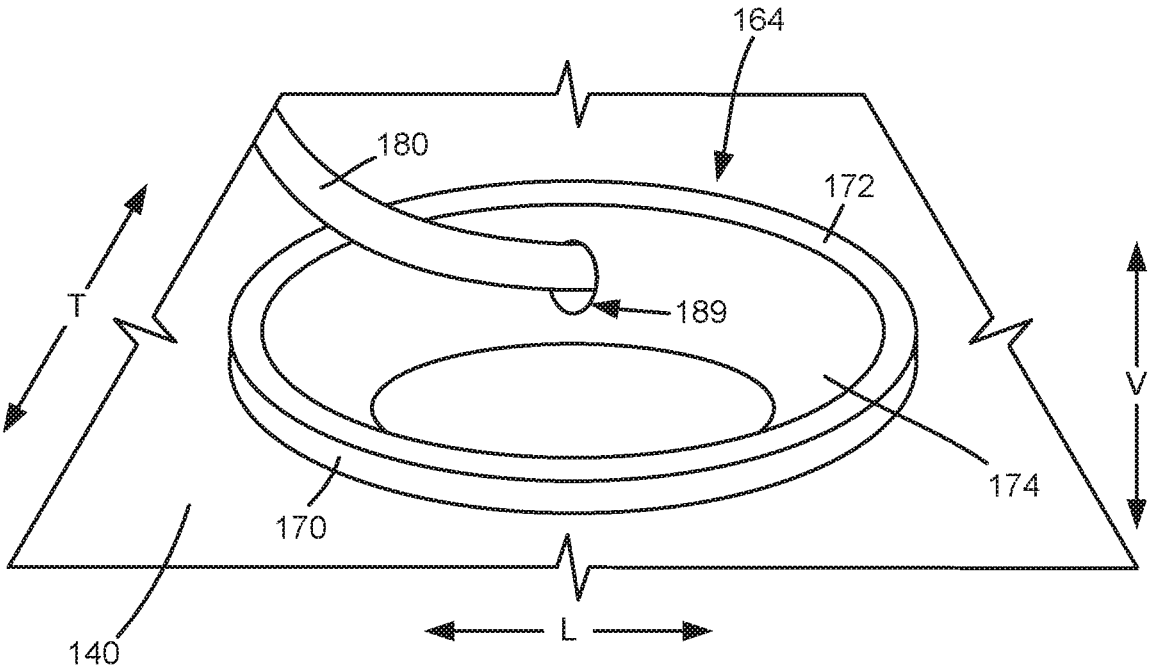
FIGS. 5 and 6 are partial perspective views of certain components of the example washing machine appliance of FIG. 1 with a docking station shown in various rotational positions.
Figure 6:
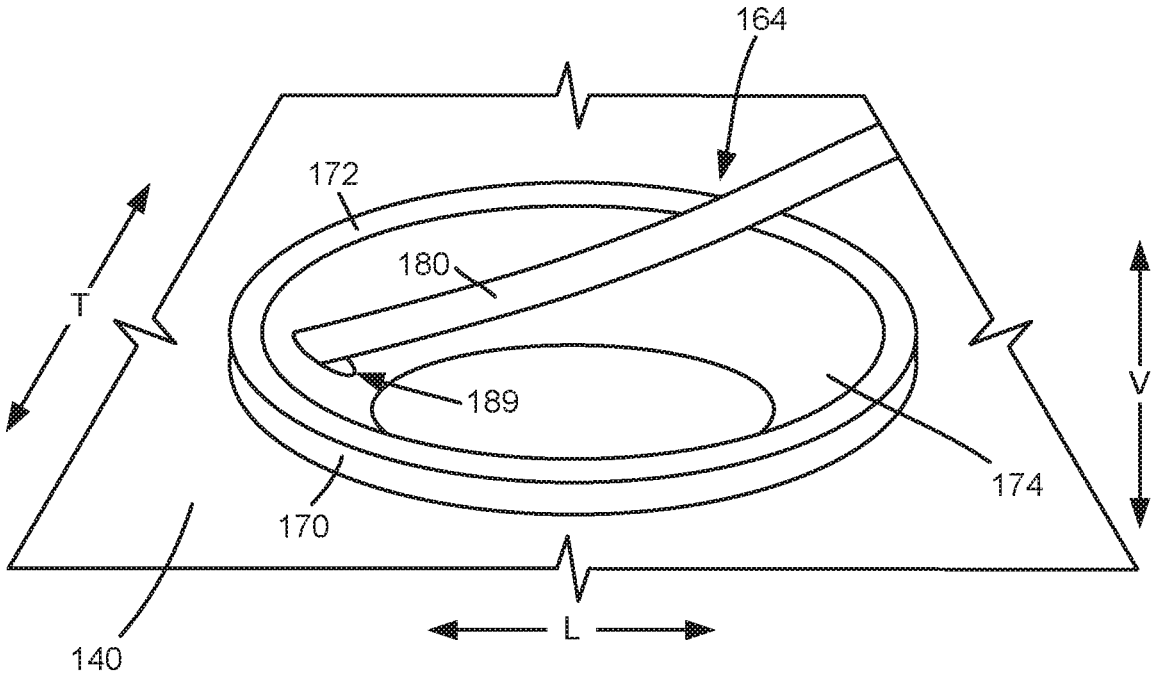

FIGS. 5 and 6 are partial perspective views of certain components of docking station 164 with docking station 164 shown in various rotational positions. As shown in FIGS. 5 and 6, docking station 164 is rotatable relative to top panel 140, e.g., about an axis that is parallel to the vertical direction V. For example, when auxiliary spray body 160 is in the undocked configuration, a user of auxiliary spray body 160 may adjust the position of auxiliary spray body 160 along the lateral direction L and/or transverse direction T over wash basket 120. By rotating relative to top panel 140, docking station 164 may limit or prevent hose 180 from kinking, e.g., an aperture 188 where hose 180 extends through docking station 164, as the user moves auxiliary spray body 160 over wash basket 120.

In FIG. 6, docking station 164 is shown rotated about ninety degrees (90°) relative to the orientation of docking station 164 shown in FIG. 5. Thus, e.g., docking station 164 may be rotatable relative to top panel 140 by no less than ninety degrees. In certain example embodiments, docking station 164 may be freely rotatable relative to top panel 140, i.e., three hundred and sixty degrees (360°), in hole 142. Such rotation of docking station 164 relative to top panel 140 may advantageously limit or prevent hose 180 from kinking as the user moves auxiliary spray body 160 over wash basket 120 along the lateral direction L and/or transverse direction T.

Turning back to FIGS. 3 and 4, docking station 164 includes an outer dock 170 and an inner bracket 176. A flange 172 of outer dock 170 is positioned above top panel 140 along the vertical direction V, and a flange 178 of inner bracket 176 is positioned below top panel 140. Thus, flange 172 of outer dock 170 and flange 178 of inner bracket 176 may be positioned opposite each other about top panel 140 along the vertical direction V. Flange 172 of outer dock 170 may support docking station 164, e.g., such that docking station 164 does not fall downwardly through hole 142. Conversely, flange 178 of inner bracket 176 may limit or prevent docking station 164 from being lifted upwardly along the vertical direction V out of hole 142. Thus, flanges 172, 176 may support docking station 164 such that docking station 164 is rotatable relative to top panel 140 while constraining translation of docking station 164 relative to top panel 140.

Outer dock 170 and inner bracket 176 are mounted to each other. In particular, outer dock 170 may be mounted to inner bracket 176 such outer dock 170 is fixed relative to inner bracket 176 when docking station 164 rotates relative to top panel 140. As an example, outer dock 170 may be snap-fit to inner bracket 176 with snap-fit connections 177 between outer dock 170 and inner bracket 176. When outer dock 170 is mounted to inner bracket 176, outer dock 170 may slide on or over top panel 140 when docking station 164 rotates relative to top panel 140.

Outer dock 170 may have a pocket 174. Pocket 174 is positioned within hole 142. Thus, e.g., pocket 174 may extend downwardly along the vertical direction V through hole 142 from flange 172 of outer dock 170. At least a portion of auxiliary spray body 160 may be positioned within pocket 174 in the docked configuration. Thus, at least a portion of auxiliary spray body 160 may be positioned below top panel 140 along the vertical direction V in the docked configuration. In such a manner, the portion of auxiliary spray body 160 positioned above top panel 140 along the vertical direction V in the docked configuration may be advantageously reduced relative to when all of auxiliary spray body 160 is positioned above top panel 140 in the docked configuration. In certain example embodiments, hole 142 may be circular, e.g., in a plane that is perpendicular to the vertical direction V, and an outer surface 175 of pocket 174 may be shaped complementary to hole 142 of top panel 140. Thus, e.g., pocket 174 may have a circular cross-section in a plane that is perpendicular to the vertical direction V at hole 142.

Figure 7:
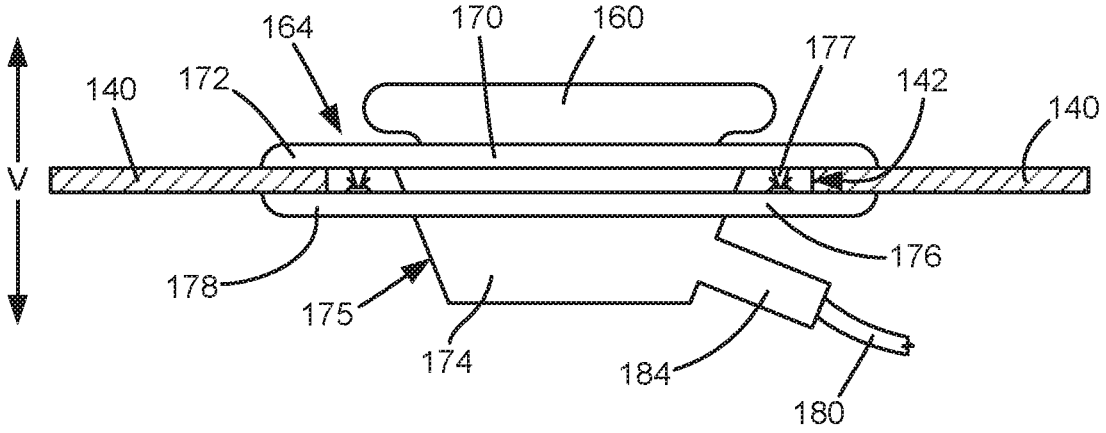
FIG. 7 is a side section view of a docking station according to another example embodiment.

Docking station 164 also includes a hose support 184. Hose support 184 is mounted to one of outer dock 170 and inner bracket 176. For example, hose support 184 is shown mounted to inner bracket 176 in FIGS. 4 and 5 such that hose support 184 extends outwardly from inner bracket 176. In particularly, hose support 184 may extend outwardly from a pocket 179 of inner bracket 176 below top panel 140. As another example, hose support 184 is shown mounted to outer dock 170 in FIG. 7 such that hose support 184 extends outwardly from outer dock 170. In particularly, hose support 184 may extend outwardly from pocket 174 of outer dock 170 below top panel 140. Aperture 188 may be positioned on pocket 179 of inner bracket 176.

Hose 180 may extend through a passage 185 (FIG. 4) of hose support 184 to auxiliary spray body 160. Thus, hose 180 may slide within passage 185 of hose support 184 when auxiliary spray body 160 adjusts between the docked configuration and the undocked configuration. Hose support 184 may limit sagging of hose 180 downwardly along the vertical direction V within cabinet 102.

As may be seen from the above, docking station 164 provides a storage location for auxiliary spray body 160. Hose 180 may extend and retract through docking station 164 as auxiliary spray body 160 is removed from and replaced on docking station 164. By rotating within hole 142 relative to top panel 140, hose 180 may extend and retract through docking station 164 more easily than compared to when docking station 164 is fixed to top panel 164.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A vertical axis washing machine appliance, comprising:

a cabinet having a top panel positioned at a top portion of the cabinet, the top panel defining a hole that extends through the top panel;

a wash tub positioned within the cabinet below the top panel;

a wash basket mounted within the wash tub such that the wash basket is rotatable relative to the wash tub about a vertical axis;

an auxiliary spray assembly comprising:

a spray body defining a plurality of ports;

a hose coupled to the spray body such that fluid is flowable into the spray body through the hose;

a docking station mounted to the top panel of the cabinet at the hole of the top panel, the spray body adjustable between a docked configuration and an undocked configuration relative to the docking station, the spray body positioned on the docking station in the docked configuration, the spray body spaced from the docking station in the undocked configuration, wherein the docking station is rotatable relative to the top panel within the hole of the top panel, and wherein the docking station comprises an outer dock and an inner bracket, a flange of the outer dock positioned above the top panel and a flange of the inner bracket positioned below the top panel, the outer dock mounted to the inner bracket such that the outer dock is fixed relative to the inner bracket when the docking station rotates relative to the top panel.

2. The vertical axis washing machine appliance of claim 1, wherein the outer dock has a pocket positioned within the hole of the top panel, at least a portion of the spray body positioned within the pocket in the docked configuration.

3. The vertical axis washing machine appliance of claim 2, wherein the hole of the top panel is a circular hole, and an outer surface of the pocket is shaped complementary to the circular hole of the top panel.

4. The vertical axis washing machine appliance of claim 1, wherein the docking station further comprises a hose support mounted to one of the outer dock and the inner bracket, the hose extending through a passage of the hose support to the spray body, the hose slidable within the passage of the hose support when the spray body adjusts between the docked configuration and the undocked configuration.

5. The vertical axis washing machine appliance of claim 1, wherein the outer dock is snap-fit to the inner bracket.

6. The vertical axis washing machine appliance of claim 1, wherein the hose defines a plurality of coils, the plurality of coils of the hose positioned within the cabinet, the plurality of coils elastically deforming when the spray body adjusts from the docked configuration to the undocked configuration.

7. The vertical axis washing machine appliance of claim 6, wherein tension within the plurality of coils urges the spray body towards the docking station when the spray body is in the undocked configuration.

8. The vertical axis washing machine appliance of claim 1, further comprising a door mounted to the cabinet such that the door provides selective access to an interior of the wash basket, the docking station positioned beneath the door when the door is in a closed position.

9. A washing machine appliance, comprising:

a cabinet having a panel, the panel defining a hole that extends through the panel;

a wash tub positioned within the cabinet;

a wash basket mounted within the wash tub such that the wash basket is rotatable relative to the wash tub;

a door mounted to the cabinet such that the door provides selective access to an interior of the wash basket; and an auxiliary spray assembly comprising:

a spray body defining a plurality of ports;

a hose coupled to the spray body such that fluid is flowable into the spray body through the hose;

a docking station mounted to the panel of the cabinet at the hole of the panel, the spray body adjustable between a docked configuration and an undocked configuration relative to the docking station, the spray body positioned on the docking station in the docked configuration, the spray body spaced from the docking station in the undocked configuration, wherein the docking station is rotatable relative to the panel within the hole of the panel, and wherein the docking station positioned is beneath the door when the door is in a closed position.

10. The washing machine appliance of claim 9, wherein the docking station comprises an outer dock and an inner bracket, a flange of the outer dock positioned opposite a flange of the inner bracket about the panel, the outer dock mounted to the inner bracket such that the outer dock is fixed relative to the inner bracket when the docking station rotates relative to the panel.

11. The washing machine appliance of claim 10, wherein the outer dock has a pocket positioned within the hole of the panel, at least a portion of the spray body positioned within the pocket in the docked configuration.

12. The washing machine appliance of claim 11, wherein the hole of the panel is a circular hole, and an outer surface of the pocket is shaped complementary to the circular hole of the panel.

13. The washing machine appliance of claim 10, wherein the docking station further comprises a hose support mounted to one of the outer dock and the inner bracket, the hose extending through a passage of the hose support to the spray body, the hose slidable within the passage of the hose support when the spray body adjusts between the docked configuration and the undocked configuration.

14. The washing machine appliance of claim 10, wherein the outer dock is snap-fit to the inner bracket.

15. The washing machine appliance of claim 9, wherein the hose defines a plurality of coils, the plurality of coils of the hose positioned within the cabinet, the plurality of coils elastically deforming when the spray body adjusts from the docked configuration to the undocked configuration.

16. The washing machine appliance of claim 15, wherein tension within the plurality of coils urges the spray body towards the docking station when the spray body is in the undocked configuration.

* * * * *